United States Patent [19]

Allen

[11] 4,389,263

[45] Jun. 21, 1983

[54] BONDING AGENT FOR NITRAMINES IN ROCKET PROPELLANTS

[75] Inventor: Henry C. Allen, Decatur, Ala.

[73] Assignee: The United States of America as represented by the Secretary of the Army, Washington, D.C.

[21] Appl. No.: 310,173

[22] Filed: Oct. 9, 1981

[51] Int. Cl.[3] ..... C06B 45/22

[52] U.S. Cl. ..... 149/11; 149/19.4; 149/21; 149/88; 149/92; 149/98; 149/111

[58] Field of Search ..... 149/11, 19.4, 21, 88, 149/92, 98, 111

[56] References Cited

U.S. PATENT DOCUMENTS 3,137,741 6/1964 Vondersmith et al. ..... 149/11 X

*Primary Examiner*—Stephen J. Lechert, Jr.

*Attorney, Agent, or Firm*—Nathan Edelberg; Robert P. Gibson; Jack W. Voigt

[57] ABSTRACT

Water-soluble protein is coated onto particles of nitramines by making a slurry of nitramine powder in a water solution of the protein and removing the water by evaporation or by filtration after previously precipitating the protein by addition of ethanol. The protein coating acts as a bonding agent to enhance the bond strength between propellant binders and the nitramine particles, resulting in substantial enhancement of desirable propellant properties.

17 Claims, 4 Drawing Figures

BONDING AGENT FOR NITRAMINES IN ROCKET PROPELLANTS

DEDICATORY CLAUSE

The invention described herein may be manufactured, used, and licensed by or for the Government for governmental purposes without the payment to me of any royalties thereon.

BACKGROUND OF THE INVENTION

Composite solid rocket propellants consist of solid particles dispersed in a rubbery matrix called the binder. The principal type of solid particle in most propellants is one or more compounds which furnish oxidizing chemical species to the combustion process and/or liberate energy upon decomposition. The structural properties of the composite propellant are strongly influenced by the strength of the bond between the binder and the surfaces of the solid particles. Since the oxidizers comprise most of the particulate matter, it is the bond between the binder and the oxidizer particle surfaces which has the greatest effect on propellant structural properties.

For composite propellants in which ammonium perchlorate (AP) is the principal oxidizer, a number of effective agents to enhance the bond of the binder to the oxidizer (bonding agents) have been discovered; for examples, refer to U.S. Pat. Nos. 3,745,074 and 4,090,893. However, for propellants in which nitramines are the principal solid oxidizer there has been very limited success in discovering effective bonding agents. Two common nitramines are HMX (cyclotetramethylenetetranitramine) and RDX (cyclotrimethylenetrinitramine).

Generally, an effective bonding agent will coat the oxidizer surface, chemically react to form an encapsulating film around the particles, and bond to the binder either chemically or adhesively. If the bonding agent film then has sufficient affinity for the oxidizer surface it will prevent binder/oxidizer separation under stress. The bonding agent may be coated onto the oxidizer particles either before incorporation of the oxidizer into the propellant mix or, in some cases, during the propellant mixing operation. It has proven to be exceptionally difficult to achieve a satisfactory bond to nitramine particles.

The structural properties of a composite propellant derive from a complex interaction of binder properties with the solid particles, and are strongly influenced by particle sizes and volumetric loading as well as by the binder/solids bond strength. When the elastomeric binder is strong relative to the binder/solids bond strength, a propellant in sufficient tension will undergo separation of the binder from the solids (sometimes called de-wetting or blanching) followed by large extensions of the binder prior to rupture. Structurally, such a propellant is characterized by high extensibility and low tensile strength. When the binder/solids bond strength is increased, as by a bonding agent, de-wetting is prevented or forestalled resulting in less extensibility and higher tensile strength.

An object of this invention is to provide a bonding agent for nitramine oxidizers in composite solid rocket propellants.

Another object of this invention is to provide a composite solid rocket propellant having increased tensile strength as a result of the use of a bonding agent for the nitramine oxidizer employed in the propellant.

SUMMARY OF THE INVENTION

Certain proteins which have been rendered soluble in warm water by prior processing are employed to coat nitramine particles. The coated nitramine particles become bonded strongly to typical composite propellant binders when they are cured, as evidenced by the change in structural properties.

Collagen proteins from animals, which are employed in this invention, have been processed in such a way that they become soluble in warm water. These processed proteins are an item of commerce. Although soluble in warm water, such proteins are insoluble in virtually all organic solvents, including the binders and plasticizers of composite propellants. In accordance with this invention a warm water solution of an appropriate protein is prepared, and the nitramine (HMX or RDX) is slurried with the protein solution. The water is removed which leaves the protein coated onto the HMX and RDX particles. Since the protein is not soluble in propellant liquids, it remains coated on the nitramine particles during propellant processing. The protein molecules contain reactive chemical groups, such as carboxyl, hydroxyl and amino groups, which react with typical propellant curing agents, such as isocyanate, epoxy and aziridine containing compounds, to both cross-link the protein film and chemically link the film to the binder network. The enhanced bond strength between binder and nitramine particles which results has a marked effect in increasing the tensile strength of the propellant.

DESCRIPTION OF THE PREFERRED EMBODIMENT

Figure 1:
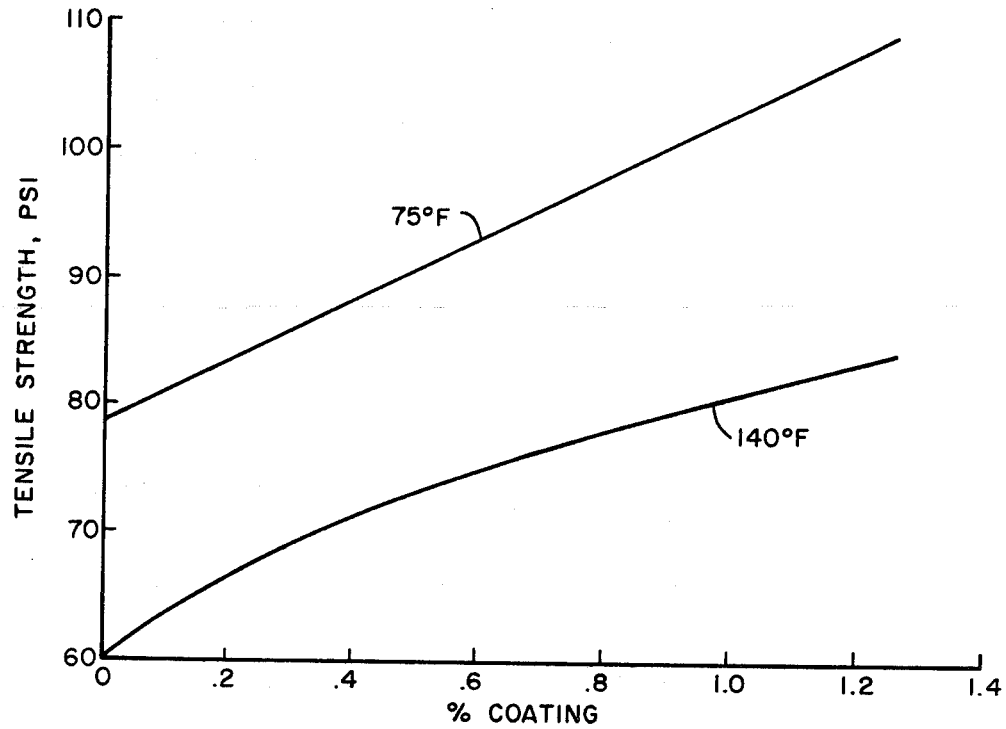
FIGS. 1 and 2 depict tensile strength of propellants made with 13 μm HMX coated at various levels of protein bonding agent.

Nitramines (HMX, cyclotetramethylenetetranitramine, and RDX, cyclotrimethylenetrinitramine) are prior coated in a water slurry of collagen proteins derived from animal sources. The coated nitramine when employed in a composite propellant composition results in enhanced bond strength between the binder and nitramine particles thereby achieving a marked increase in the tensile strength of the propellant.

The following example illustrates one preparatory technique for using the bonding agent in accordance with this invention.

EXAMPLE

One part (all parts are given by weight) of protein 5 V from Estech Specialty Chemical Corporation was dissolved in 99 parts of distilled water at 60° C. Then 2.5 parts of this solution were diluted with 1.5 parts distilled water and mixed with 10.0 parts of HMX having a nominal particle diameter of 12.6 micrometers. The resulting slurry was of a good consistency for handling, and was thick enough that settling of particles did not occur. The slurry was spread on a Teflon film in open air to allow the water to evaporate. When dry, the coated HMX was a friable cake. The cake was broken up with a hard rubber spatula and put through a sieve with 62 micrometer openings. The sieved powder of coated HMX was more free-flowing than uncoated powder, but did not produce as much air-borne dust. An uncured binder mixture was prepared which contained a large percentage of mixed nitrate esters as energetic plasticizers, and propellant mixtures containing 50 parts each of binder and HMX were prepared with both coated and uncoated 12.6 micrometer HMX. These propellant mixtures were cast into suitable ring molds and cured 16 hours at 65° C. These rings were then tested for structural properties at four temperatures with the results shown in Table 1.

| Temp. °F. | Property | HMX Type Uncoated | Coated |
|---|---|---|---|
| 140 | Tensile strength ($\sigma$m, psi) | 36 psi | 64 psi |
| | Strain @ max. load ($\epsilon$m, %) | 47.1% | 47.5% |
| | Strain @ rupture ($\epsilon$b, %) | 48.3% | 47.5% |
| | Maximum tangent modulus (E, psi) | 132 psi | 265 psi |
| 77 | Tensile strength | 41 psi | 64 psi |
| | Strain @ max. load | 82.9% | 46.3% |
| | Strain @ rupture | 83.5% | 47.7% |
| | Maximum tangent modules | 130 psi | 227 psi |
| −40 | Tensile strength | 200 psi | 304 psi |
| | Strain @ max. load | 100.1% | 35.3% |
| | Strain @ rupture | 106.4% | 52.2% |
| | Maximum tangent modulus | 1322 psi | 1983 psi |
| −65 | Tensile strength | 1063 psi | 1072 psi |
| | Strain @ max. load | 16.9% | 19.5% |
| | Strain @ ruptue | 21.2% | 29.1% |
| | Maximum tangent modulus | 17,470 psi | 16,676 psi |

The data in Table 1 show that the protein coating on HMX produced desirable changes in propellant properties characteristic of an effective bonding agent. In addition, the fractured surfaces of the two propellants broken in tension were examined microscopically, and the uncoated HMX was found to be loosened from the binder while the coated HMX was still apparently tightly bonded to the binder. Therefore, it is concluded that the protein coating on the HMX produced a desirable change in structural properties as compared to uncoated HMX, and that the change was caused through the mechanism of the protein acting as a bonding agent to strengthen the binder/nitramine bond.

ADDITIONAL EXPERIMENTAL COATING EVALUATIONS

A second coating process was developed which exploited the protein's insolubility in organic solvents. It was first determined that 1% protein in water was essentially completely precipitated by adding ethanol amounting to 2.5 times the volume of the water. This procedure was then carried out with nitramine slurried in the protein solution in water, with continuous stirring while adding the ethanol; the slurry was filtered after precipitation and the filtrate was found to leave no significant residue upon evaporation. This demonstrated that the protein was left on the filter with the nitramine by this precipitation process, but it did not prove that the protein was coated on the nitramine.

Examination of particles under an optical microscope failed to resolve whether the nitramine was coated with protein, so particles were placed in acetone to dissolve the nitramine in order that the insoluble protein could be inspected. It was seen that each nitramine particle, after dissolving, left behind an insoluble film. This was taken as satisfactory evidence that the protein was coated on the nitramine. Although several mixes were made with nitramines coated by the evaporative process, the process of choice for small scale work was precipitation of the protein, filtration of the slurry and drying of the filter cake. Caking of the nitramine presented little problem with this process.

Additional evaluations and testings discussed below include the experimental propellant employed to evaluate the coated nitramines and the mechanical property testing and experimental data obtained therefrom.

The Experimental Propellant.

The vehicle selected for evaluation of coated nitramines was an in-house minsmoke propellant formulation developed for a motor demonstration program. It contained 56% by weight nitramine, 3% of other fine particle solids, and 41% binder selected from a first and a second binder disclosed hereinbelow. The 3% fine particle solids included materials which function as stabilizers, ballistic modifiers, and opacifiers; examples of such materials serving these functions are zirconium carbide, lead oxide, and carbon black. The first binder consisted of mixed polyesters (7.06 parts) and nitrocellulose (1.11 parts) plasticized with 30.45 parts of a 70/30 blend of nitroglycerine (NG) and butanetrioltrinitrate (BTTN), and cured with 1.31 parts of a diisocyanate. Mixes were processed in a one-pint vertical mixer, adding the polymer/plasticizer lacquer first, then the nonnitramine solids. Nitramine was added next, and mixed until well wetted, at which point a vacuum was pulled in the mixer. After 60 minutes mixing at 120° F., the curing agent, isophorone diisocyanate, (IPDI, 1.025 NCO/OH) and catalyst, triphenylbismuthine, (TPB) were added, and the batch was mixed another 20 minutes under vacuum. The propellant was then vacuum cast into block molds and cured at either 120° or 150° F., as discussed below.

Mechanical Property Testing.

Cured propellant blocks were cut into slices 0.25 inch thick from which JANNAF dogbones were stamped. These were tested on an Instron tensile tester at 2.0 inches/minute cross-head speed at temperatures of 140°, 75°, −40° and −65° F. The data were computer reduced to digital form and the Instron strip-chart traces were converted to the conventional stress-strain format for evaluation and interpretation purposes.

The Experimental Data.

Nitramines in moderately fine and coarse nominal particle sizes were selected for evaluation. Included were HMX in sizes of 13 $\mu$m and 110 $\mu$m weight mean diameter and RDX of 14 $\mu$m WMD. Control propellant samples with the noncoated nitramines were prepared with each of these materials. Nitramines from the same lots were then coated with 0.25% protein by the evaporative process and incorporated into mixes. Table II sets forth the mechanical properties of propellants with uncoated (control) and 0.25% protein-coated (evaporative-process) nitramines.

TABLE II

MECHANICAL PROPERTIES OF PROPELLANTS WITH UNCOATED AND 0.25% PROTEIN-COATED (EVAPORATIVE-PROCESS) NITRAMINES

| | | #1 *14 RDX Control | #2 13 HMX Control | #3 110 HMX Control | #4 14 CRDX | #5 13 CHMX | #6 110 CHMX | #7 13 CHMX (well dried) |
|---|---|---|---|---|---|---|---|---|
| 140° F. | σm, psi | 46.3 | 60.0 | 23.1 | 31.1 | 36.2 | 24.0 | 55.7 |
| | εm, % | 109.2 | 95.9 | 22.2 | 77.7 | 58.9 | 34.2 | 54.0 |
| | εb, % | 109.2 | 95.9 | 22.2 | 77.7 | 59.2 | 34.2 | 54.0 |
| | E, psi | 166 | 207 | 161 | 92 | 107 | 170 | 152 |
| 75° F. | σm, psi | 56.9 | 73.8 | 25.7 | 45.1 | 48.2 | 28.8 | 64.1 |
| | εm, % | 123.1 | 115.1 | 24.6 | 95.6 | 70.6 | 41.6 | 58.6 |
| | εb, % | 123.1 | 115.1 | 29.6 | 95.6 | 72.2 | 41.6 | 64.7 |
| | E, psi | 193 | 235 | 179 | 122 | 124 | 163 | 171 |
| −40° F. | σm, psi | 196.1 | 227.0 | 123.6 | 220.5 | 231.9 | 153.7 | 290 |
| | εm, % | 25.6 | 20.2 | 13.2 | 31.0 | 31.7 | 22.8 | 30.8 |
| | εb, % | 148.3 | 132.9 | 139.7 | 62.6 | 77.8 | 119.9 | 67.2 |
| | E, psi | 1334 | 1406 | 1755 | 1157 | 905 | 1115 | 1262 |
| −65° F. | σm, psi | 868 | 898 | 491 | 923 | 969 | 539 | 935 |
| | εm, % | 18.3 | 24.6 | 11.8 | 16.2 | 20.3 | 21.2 | 21.9 |
| | εb, % | 54.4 | 41.5 | 34.2 | 36.2 | 31.1 | 48.3 | 41.3 |
| | E, psi | 8300 | 7410 | 7960 | 9197 | 8634 | 6523 | 6623 |
| Brookfield viscosity, kP @ 120° F. | | 0.14 | 0.14 | 0.11 | 0.19 | 0.13 | 0.06 | 0.24 |

*The number before the nitramine designates the nominal particle size in micrometers. The letter "c" indicates coated, (e.g., CHMX, CRDX)

The decreased values seen for σm and E with the coated fine nitramines suggested that curing agent was being consumed by a side reaction. Two possibilities were considered, one being reaction of isocyanate with residual water in the protein coating and the other being reaction with active hydrogen on the protein itself. A mix was made using more thoroughly dried coated 13 μm HMX (13 CHMX) which is also shown in Table II. Although thorough drying of the coated HMX increased σm and E relative to the first 13 CHMX mix, it did not bring them up to the level of the control mix. An attempt to measure isocyanate consumption of a protein film at 120° F. indicated no significant consumption, but the data were not considered sufficiently reliable to enable a definite conclusion.

Two mixes were made to determine whether cure temperature was a factor in mechanical properties. Mixes were made with and without 0.25% protein coating by the evaporative process on 13 μm HMX, and were divided into halves. Half of each mix was cured at 120° F. and at 150° F. to constant Shore A hardness. The data are shown in Table III. A 150° F. cure was adopted for the remaining work because of the apparent small increase in modulus at higher test temperatures.

The next series of mixes evaluated the effect of protein coating level on mechanical properties. Using the precipitation coating process, 13 μm HMX was coated at levels of 0.25, 0.50 and 1.25% while 110 μm HMX was coated at 0.50 and 1.00% levels. Propellant mechanical property data are shown in Table IV. Rather sharp changes in mechanical properties are evident when compared to the controls in Table II. Mix viscosity also was seen to increase with coating level.

TABLE III

THE EFFECT OF CURE TEMPERATURE ON PROPELLANT WITH COATED (EVAPORATIVE) PROCESS, 0.25%) AND UNCOATED MIX

| | Mix No. | #8A | #8B | #9A | #9B |
|---|---|---|---|---|---|
| | Cure Temp. | 120° F. | 150° F. | 120° F. | 150° F. |
| | Nitramine | 13 CHMX | 13 CHMX | 13 HMX | 13 HMX |
| 140° | σm, psi | 60.7 | 61.8 | 58.9 | 58.0 |
| | εm, % | 55.8 | 42.9 | 92.5 | 82.0 |
| | εb, % | 56.4 | 42.9 | 92.5 | 82.0 |
| | E, psi | 199 | 256 | 204 | 224 |
| 75° | σm, psi | 69.5 | 72.2 | 79.4 | 75.5 |
| | εm, psi | 50.0 | 60.1 | 117.5 | 112.9 |
| | εb, psi | 66.6 | 64.8 | 117.5 | 112.9 |
| | E, psi | 204 | 266 | 216 | 238 |
| −40° | σm, psi | 299 | 316 | 239 | 217 |
| | εm, psi | 32.4 | 32.0 | 143.8 | 139.4 |
| | εb, psi | 59.2 | 81.2 | 144.9 | 140.5 |
| | E, psi | 1507 | 1595 | 1200 | 1070 |
| −65° | σm, psi | 947 | — | 984 | 1020 |
| | εm, psi | 19.0 | — | 16.6 | 16.4 |
| | εb, psi | 39.0 | — | 24.9 | 38.8 |
| | E, psi | 10631 | — | 10376 | 13865 |
| Brookfield viscosity, kP @ 120° F. | | 0.22 | 0.22 | 0.18 | 0.18 |

TABLE IV

EFFECT OF PROTEIN COATING LEVEL ON THE MECHANICAL PROPERTIES OF MINSMOKE PROPELLANT WITH HMX

| | Mix No. | #10 | #11 | #12 | #13 | #14 |
|---|---|---|---|---|---|---|
| | % Coating | 0.25 | 0.50 | 1.25 | 0.50 | 1.00 |
| | Nitramine | 13 CHMX | 13 CHMX | 13 CHMX | 100 CHMX | 110 CHMX |
| 140°F. | σm, psi | 67.3 | 73.5 | 83.9 | 34.8 | 53.3 |
| | εm, % | 31.4 | 31.4 | 33.3 | 25.8 | 25.3 |
| | εb, % | 32.5 | 31.4 | 33.3 | 25.8 | 25.3 |
| | E, psi | 296 | 293 | 288 | 314 | 363 |
| 75° F. | σm, psi | 75.1 | 90.7 | 109.1 | 39.5 | 61.5 |
| | εm, % | 31.0 | 34.5 | 35.1 | 29.9 | 27.2 |
| | εb, % | 37.0 | 35.3 | 36.3 | 29.9 | 27.2 |
| | E, psi | 325 | 330 | 428 | 348 | 472 |
| −40° F. | σm, psi | 255 | 301 | 381 | 157 | 199 |
| | εm, % | 29.2 | 36.0 | 45.8 | 15.0 | 26.3 |
| | εb, % | 64.3 | 55.1 | 54.9 | 85.3 | 54.1 |
| | $E_o$, psi | 1355 | 1404 | 1456 | | 1808 |
| −65° F. | σm, psi | 923 | 1255 | 1244 | 883 | 850 |
| | εm, % | 19.7 | 12.2 | 23.3 | 4.4 | 4.0 |
| | εb, % | 29.9 | 21.6 | 23.7 | 17.7 | 10.3 |
| | E, psi | 12875 | 19092 | 21220 | 21823 | 22083 |
| Brookfield viscosity, kP @ 120° F. | | 0.19 | 0.43 | 0.6 | 0.35 | 0.38 |

The usefulness of the protein bonding agent of this invention has been further demonstrated by employing the protein coated nitramine oxidizer powder in combination with the fine particle solids and a second binder system described hereinbelow.

The second binder consisted of approximately equal amounts (about 2.5 parts each) of polymers of ethylene oxide and caprolactone, both having functional hydroxyl groups for the cure reaction, and about 0.2 parts of cellulose acetate butyrate, which contains residual hydroxyl groups, as a cross-linker for the binder. The polymer network is cured with about 0.87 parts of a polyfunctional isocyanate and is plasticized with about 22.8 parts of mixed nitrate esters consisting of about equal amounts of butanetrioltrinitrate (BTTN), triethyleneglycoldinitrate (TEGDN), and trimethylolpropanetrinitrate (TMETN).

The test propellant made with the second binder system described above included, as also used with the first binder system, about 3% fine particle solids which include materials which function as stabilizers, ballistic modifiers, and opacifiers (examples of such materials serving these functions are zirconium carbide, lead oxide, and carbon black). About 56% by weight nitramine oxidizer (uncoated and coated 16 micrometers RDX) was employed in the control and test propellant respectively. The finished propellants had properties as set forth in Table V below.

TABLE V

Propellant Properties Employing Polymers of Ethylene Oxide and Caprolactone Binder Systems and 1.00% Coated and Uncoated 16 Micrometer RDX

| | Properties | Uncoated RDX | Coated RDX |
|---|---|---|---|
| 75° F. | σm, psi | 26 | 46 |
| | εm, % | >515 | 234 |
| | εb, % | >515 | 234 |
| | E, psi | 40 | 31 |
| −40° F. | σm | 134 | 196 |
| | εm | >435 | 167 |
| | εb | >435 | 232 |
| | E | 125 | 585 |
| −65° F. | σm | 590 | 1012 |
| | εm | 26.2 | 20.1 |
| | εb | 40.1 | 43.5 |
| | E | 1456 | 6624 |

The significant points about these data are that the bonding agent gave a badly needed increase in maximum load-bearing capability (σm) over the whole temperature range, while the strain capabilities (εm and εb) remained well above any conceivable need at higher temperatures and were about equal for the two propellants at −65° F.

Three μm RDX was coated with 1% protein and evaluated in the first binder system described above. However, it was not used as the sole nitramine in the propellant, but as a blend with 16 μm RDX at a 60/40 ratio of 16/3 μm. No control mix using an uncoated blend was made, but the properties clearly indicated that the 3 μm as well as the 16 μm RDX was bonded to the binder. Of greater interest, however, is the finding that better properties are obtained when only the coarser fraction of such a particle size blend is bonded with the protein. A mix is made in which 60% of the nitramine was 16 μm RDX coated with 1.0% protein, and 40% was uncoated 3 μm RDX. This propellant exhibited the following properties as shown in Table VI below.

TABLE VI

Experimental Propellant Properties For a Propellant Employing a 60/40 Blend of 16 Micrometer 1.0% Protein Coated RDX and Uncoated 3 Micrometer RDX

| | 140° F. | 75° F. | −40° F. | −65° F. |
|---|---|---|---|---|
| σm | 64 | 90 | 415 | 1655 |
| εm | 53 | 59 | 41 | 15 |
| εb | 53 | 59 | 58 | 18 |
| E | 177 | 191 | 2046 | 24663 |

The attainment of high σm at the higher temperatures with retention of excellent εm and εb values down to −40° F. are thought to be the result of internal stress relief in the propellant due to de-wetting of the uncoated 3 μm RDX while the coated 16 μm particles remain bonded and provide filler reinforcement.

The data show that the protein coating is equally effective as a bonding agent on either HMX or RDX on all particle sizes tested. Therefore, the nitramine oxidizer powder can be selected from HMX or RDX in the appropriate particle size since the data indicate that the protein can function as a bonding agent on virtually any particle size nitramine oxidizer powder. The selection of particle size and the blending of coated and uncoated oxidizer can result in a variety of improved properties over a wide temperature range of use.

DISCUSSION OF THE RESULTS

Effect of Bonding Agent on Tensile Strength.

Figure 2:
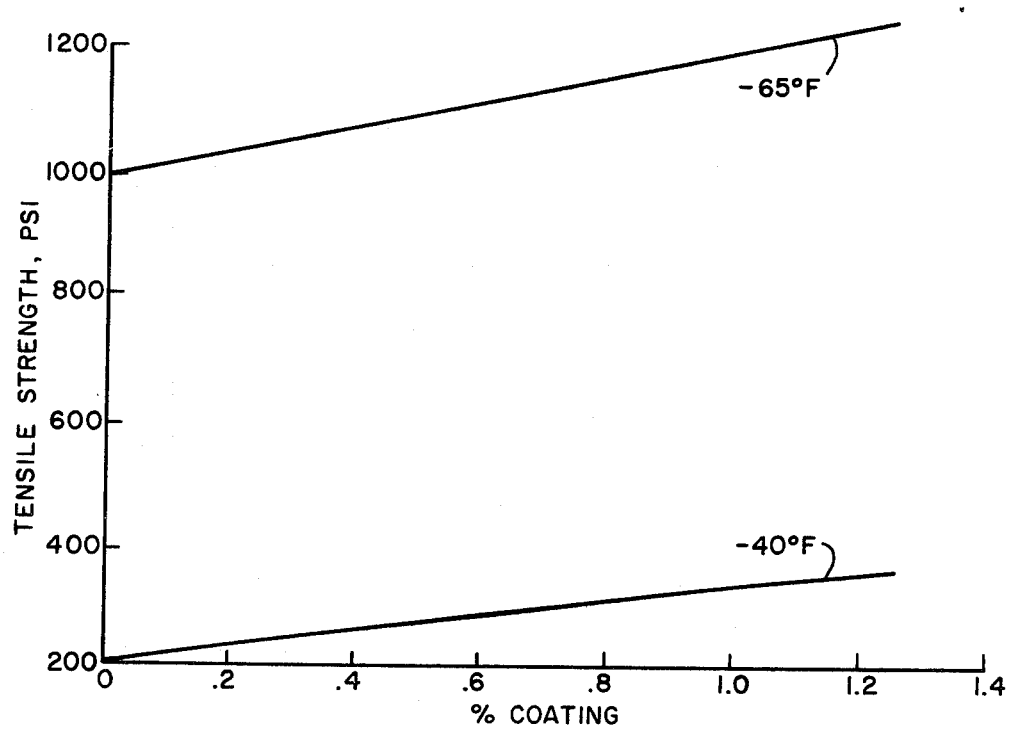
Figure 3:
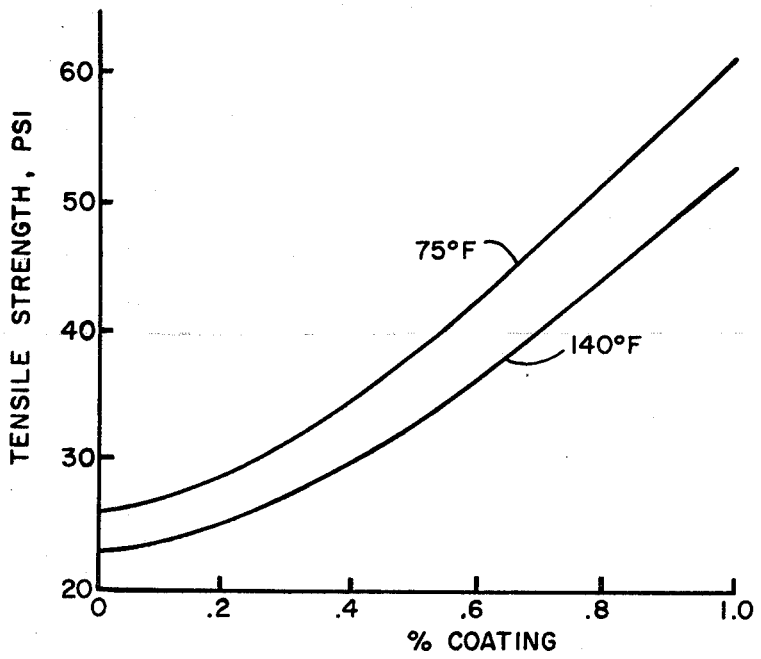
FIGS. 3 and 4 depict tensile strength of propellants made with 110 μm HMX coated at various levels of protein bonding agent.
Figure 4:
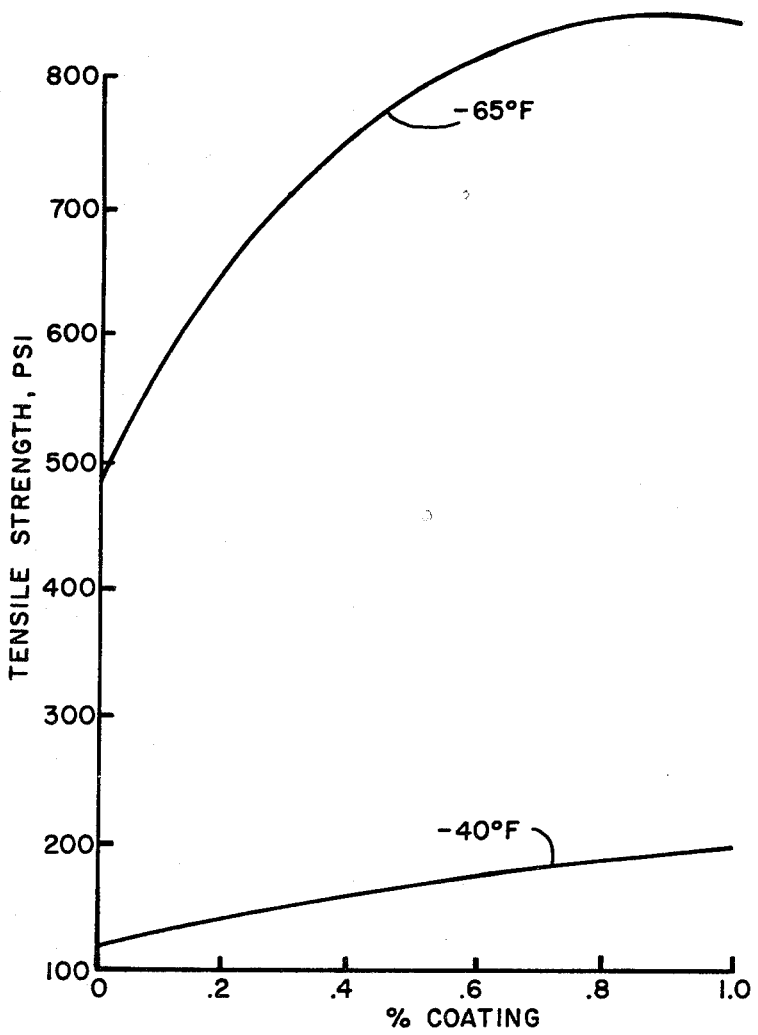

FIGS. 1 and 2 show $\sigma m$ versus coating levels for propellant with 13 μm HMX and FIGS. 3 and 4 show the same relationship for 110 μm HMX. It is clear enough that the protein coating significantly raised $\sigma m$, the values at 75° and 140° F. being more than doubled with 110 μm HMX. Not only were the values of $\sigma m$ increased, but other changes were seen as well, some of which were different for 13 μm HMX than for 110 μm HMX. Therefore, the results obtained with the two particle sizes will be discussed separately.

Effect of Bonding Agent on Stress-Strain Behavior with 13 μm HMX.

With 13 μm HMX the position as well as the magnitude of $\sigma m$ was changed by the bonding agent. Even at the lowest coating level of 0.25% $\epsilon m$ at 75° and 140° F. was reduced drastically to a level which remained nearly constant with further increases in coating level. Also, $\epsilon m$ and $\epsilon b$ were no longer identical as they were in the control propellant. These changes are taken as an indication that the coating increased propagative de-wetting stress ($\sigma dp$) as intended, and that $\sigma dp$ for at least some of the particles became greater than the rupture stress of de-wetted propellant ($B\sigma$). If $B\sigma$ at failure of the control propellant is representative of matrix properties, then $\sigma dp$ with coated 13 μm HMX became greater than 74 psi at 75° F., which is the $B\sigma$ of the control mix (#2) at failure at that temperature ($B\sigma$ must equal $\sigma m$ in a fully de-wetted propellant in which $\epsilon m = \epsilon b$). A very appealing correlation appears from this in that $\sigma m$ at 75° F. with 0.25% coating was 75 psi, and even higher with greater coating levels.

Effect of Bonding Agent on Stress-Strain Behavior with 110 μm HMX.

The control mix with uncoated 110 μm HMX (#3) is seen in Table II to have low values for $\sigma m$, $\epsilon m$ and $\epsilon b$ at 75° and 140° F. Thus, average values for de-wetting stresses must be low, but even so the value of $B\sigma$ is less than the $\sigma dp$ value of much of the HMX at low strain. Thus, the poor properties resulting from use of large particle size HMX is attributable to a low value of $B\sigma$ at $\epsilon b$. This low value of $B\sigma$ may well be due to the relatively low internal surface area of the vacuoles around de-wetted particles when coarse nitramine is used.

Application of Results to RDX.

After the initial screening with 0.25% coating by the evaporative process (Table II), a mix was made with 14 μm RDX coated at the 1.00% level by the precipitation process and with cure stoichiometry increased to 1.10 NCO/OH. The properties of this propellant are:

| | 140° F. | 75° F. | −40° F. | −65° F. |
|---|---|---|---|---|
| $\sigma m$, psi | 68 | 89 | 352 | 1446 |
| $\epsilon m$, % | 30.7 | 31.4 | 24.6 | 10.8 |
| $\epsilon b$, % | 30.7 | 31.4 | 48.9 | 16.9 |
| E, psi | 293 | 433 | 2626 | 32,400 |

When these data are compared to the RDX control in Table II (#1), the action of the bonding agent is seen in increased $\sigma m$ and E, and decreased $\epsilon m$ and $\epsilon b$, including ample allowance for the effects of the change in cure stoichiometry. Thus, the protein coating appears to be as effective a bonding agent with RDX and with HMX.

It is concluded that collagen protein is an effective bonding agent for the nitramines HMX and RDX when pre-coated onto the particles before propellant mixing. Its effects on the stress-strain behavior of a minsmoke propellant with an energetic binder are in agreement with predictions of an analytical technique which was used to interpret the stress-strain behavior of this type of propellant with well-bonded and poorly bonded nitramine particles.

I claim:

1. In a propellant composition comprised of about 41 weight percent binder selected from a first binder consisting of mixed polyesters, nitrocellulose, and a diisocyanate curing agent plasticized with 70/30 weight percent blend of nitroglycerine and butanetrioltrinitrate, or a second binder consisting of polymers of ethylene oxide and polymers of caprolactone, cellulose acetate butyrate crosslinker, and a polyfunctional isocyanate curing agent plasticized with mixed nitrate esters consisting of about equal amounts of butanetrioltrinate, triethyleneglycoldinitrate, and trimethylolpropanetrinitrate; and including the additional propellant ingredients employed with said binder system selected of about 3 weight percent of fine particle solids which function as stabilizers, ballistic modifiers, and opacifiers, and about 56 weight percent of a nitramine oxidizer powder selected from the nitramine oxidizers consisting of cyclotetramethylenetetranitramine and cyclotrimethylenetrinitramine, said nitramine oxidizer powder consisting of particle sizes ranging from about 3 micrometers and larger, said larger nitramine oxidizer powder being coated, the improvement to propellant properties achieved by employing a prior coating process to effect a coating on said larger nitramine oxidizer powder of a collagen protein derived from animal source prior to incorporating said selected nitramine oxidizer powder into said propellant composition, said coated nitramine oxidizer powder having a collagen protein coating from about 0.25 weight percent to about 1.25 weight percent which functions as a bonding agent to enhance the bond strength between the propellant binders and nitramine particles to thereby result in substantial enhancement of desirable propellant properties including tensile strength, and initial tangent modulus.

2. The improvement as set forth in claim 1 wherein said nitramine oxidizer powder of nominal particle size of about 3 micrometers is also coated with said collagen protein.

3. The improvement as set forth in claim 1 wherein said prior coating process employed to coat said nitramine oxidizer powder comprises dissolving about one part by weight of said collagen protein in about 99 parts by weight of distilled water to form a water solution of said collagen protein; diluting about 2.5 parts of said collagen protein solution with about 1.5 parts of distilled water; mixing about 10.0 parts of said nitramine oxidizer powder having a selected nominal particle diameter from about 12 micrometers to about 110 micrometers into said diluted collagen protein solution to form a slurry which coats said nitramine oxidizer powder particles; evaporating said water from said slurry; drying said coated nitramine oxidizer powder particles; and screening said dried nitramine oxidizer powder particles through a sieve to yield a free-flowing nitramine oxidizer powder having a uniform coating of said collagen protein thereon.

4. The improvement as set forth in claim 3 wherein said nitramine oxidizer powder selected is cyclotetramethylenetetranitramine having a nominal particle diameter of about 13 micrometers.

5. The improvement as set forth in claim 3 wherein said nitramine oxidizer powder selected is cyclotrimethylenetrinitramine having a nominal particle diameter of about 14 micrometers.

6. The improvement as set forth in claim 3 wherein said nitramine oxidizer powder selected is cyclotetramethylenetetranitramine having a nominal particle diameter of about 110 micrometers.

7. The improvement as set forth in claim 3 wherein said nitramine oxidizer powder selected is cyclotrimethylenetrinitramine having a nominal particle diameter of about 110 micrometers.

8. The improvement as set forth in claim 2 wherein said nitramine oxidizer powder selected is a blend of cyclotrimethylenetrinitramine having a range of nominal particle diameter of about 16 micrometers and a nominal particle diameter of about 3 micrometers, said cyclotrimethylenetrinitramine being in ratio of about 60 of said 16 micrometers to about 40 of said 3 micrometers of said cyclotrimethylenetrinitramine.

9. The improvement as set forth in claim 2 wherein said nitramine oxidizer powder selected is a blend of cyclotetramethylenetetranitramine having a range of nominal particle diameter of about 16 micrometers and a nominal particle diameter of about 3 micrometers, said blend of cyclotetramethylenetetranitramine being in ratio of about 60 of said 16 micrometers to about 40 of said 3 micrometers.

10. The improvement as set forth in claim 3 wherein said nitramine oxidizer powder selected is a blend of cyclotrimethylenetrinitramine having a range of nominal particle diameter of about 16 micrometers and a nominal particle diameter of about 3 micrometers, said blend of cyclotrimethylenetrinitramine being in ratio of about 60 of said 16 micrometers to about 40 of said 3 micrometers of said cyclotrimethylenetrinitramine.

11. The improvement as set forth in claim 3 wherein said nitramine oxidizer powder selected is a blend of cyclotetramethylenetetranitramine having a range of nominal particle diameter of about 16 micrometers and a nominal particle diameter of about 3 micrometers, said blend of cyclotetramethylenetetranitramine being in ratio of about 60 of said 16 micrometers to about 40 of said 3 micrometers of said cyclotetramethylenetetranitramine.

12. The improvement as set forth in claim 1 wherein said prior coating process employed to coat said nitramine oxidizer powder comprises dissolving about one part by weight of said collagen protein in about 99 parts by weight of distilled water to form a water solution of said collagen protein; mixing about 100 parts of said nitramine oxidizer powder having a selected nominal particle diameter from about 12 micrometers to about 110 micrometers into said collagen protein solution to form a slurry; slowly adding to said slurry, while stirring, a predetermined volume of ethanol to equal about 2.5 times the volume of said distilled water to precipitate said collagen protein onto said nitramine oxidizer powder; filtering said water and ethanol solution to recover said nitramine oxidizer powder having a coating of said collagen protein thereon; drying said coated nitramine oxidizer powder particles; and screening said dried nitramine oxidizer powder particles through a sieve to yield a free-flowing nitramine oxidizer powder having a uniform coating of said collagen protein thereon.

13. The improvement as set forth in claim 12 wherein said nitramine oxidizer powder selected is cyclotetramethylenetetranitramine having a nominal particle diameter of about 13 micrometers.

14. The improvement as set forth in claim 12 wherein said nitramine oxidizer powder selected is cyclotetramethyleneletranitramine having a nominal particle diameter of about 110 micrometers.

15. The improvement as set forth in claim 12 wherein said nitramine oxidizer powder selected is cyclotrimethylenetrinitramine having a nominal particle diameter of about 14 micrometers.

16. The improvement as set forth in claim 12 wherein said nitramine oxidizer powder selected is a blend of cyclotetramethylenetetranitramine having a range of nominal particle diameter of about 16 micrometers and a nominal particle diameter of about 3 micrometers, said blend of cyclotetramethylenetetranitramine being in ratio of about 60 of said 16 micrometers to about 40 of said 3 micrometers.

17. The improvement as set forth in claim 12 wherein said nitramine oxidizer powder selected is a blend of cyclotrimethylenetrinitramine having a range of nominal particle diameter of about 16 micrometers and a nominal particle diameter of about 3 micrometers, said blend of cyclotrimethylenetrinitramine being in ratio of about 60 of said 16 micrometers to about 40 of said 3 micrometers of said cyclotrimethylenetrinitramine.

* * * * *